United States Patent [19]

Huizenga

[11] Patent Number: 4,928,833

[45] Date of Patent: May 29, 1990

[54] STORAGE ORGANIZER SYSTEM AND MEANS FOR INSTALLING THE SAME

[76] Inventor: Lee M. Huizenga, 1298 Waukazoo Dr., Holland, Mich. 49424

[21] Appl. No.: 235,976

[22] Filed: Aug. 24, 1988

[51] Int. Cl.[5] ..... A47F 5/08

[52] U.S. Cl. ..... 211/187; 211/90; 211/94; 108/152; 312/245

[58] Field of Search ..... 211/94, 87, 90, 187; 312/245; 108/111, 152

[56] References Cited

U.S. PATENT DOCUMENTS

| | | | |
|---|---|---|---|
| 3,899,228 | 8/1975 | Schreiber | 312/245 |
| 4,160,570 | 7/1979 | Bridges | 312/245 |
| 4,324,076 | 4/1982 | Honickman | 108/111 X |
| 4,403,700 | 9/1983 | Manlove | 312/245 X |
| 4,634,010 | 1/1987 | Otema | 211/90 X |

*Primary Examiner*—Robert W. Gibson, Jr.

*Attorney, Agent, or Firm*—Price, Heneveld, Cooper, DeWitt & Litton

[57] ABSTRACT

A storage organizer system and method of installation in which the system is formed of a plurality of panels arranged parallel to each other and extend from a support wall. An elongated rail is mounted horizontally on said support wall and has a projection extending upwardly and away from said wall. Each of the panels have a cut out shaped to receive the rail projection whereby the panels are first hung on the rail and thereafter support elements are mounted between the panels. Preferably the end panels are mounted on the rail with one side abutting one of spaced walls extending perpendicular from the support wall so as to prevent the end walls from spreading whereby the support elements can be cut to exact length and wedged between the panels to provide a right-to-left tight fit.

15 Claims, 2 Drawing Sheets

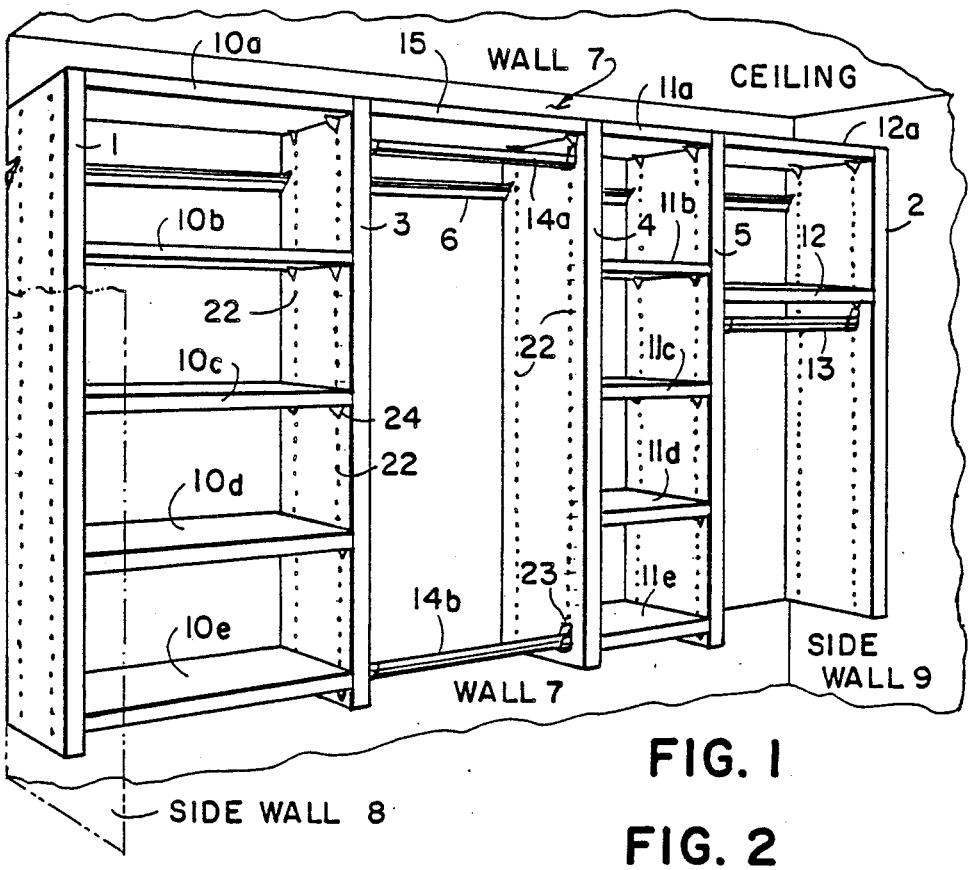
FIG. 1
FIG. 2
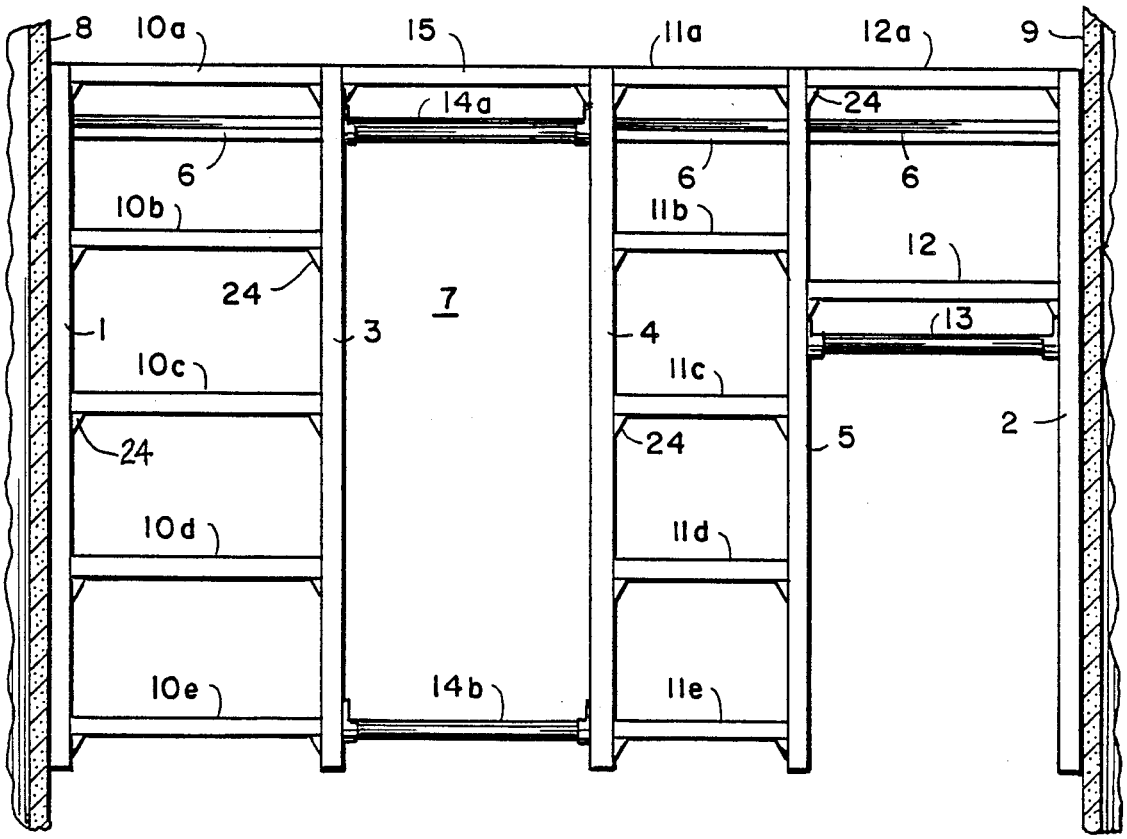

FIG. 3
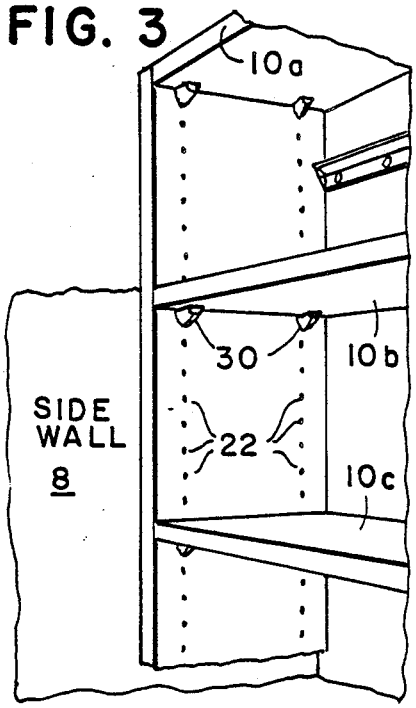
FIG. 11
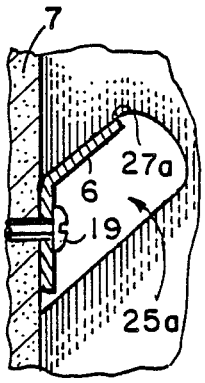
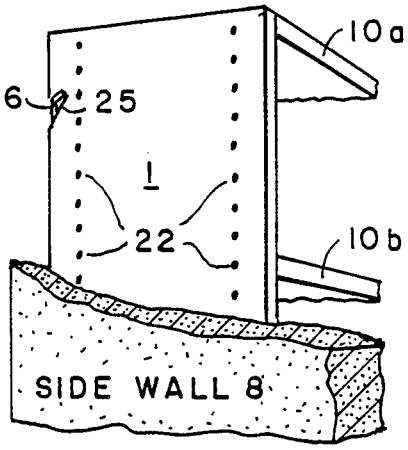
FIG. 4
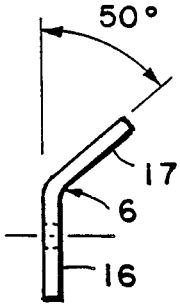
FIG. 7
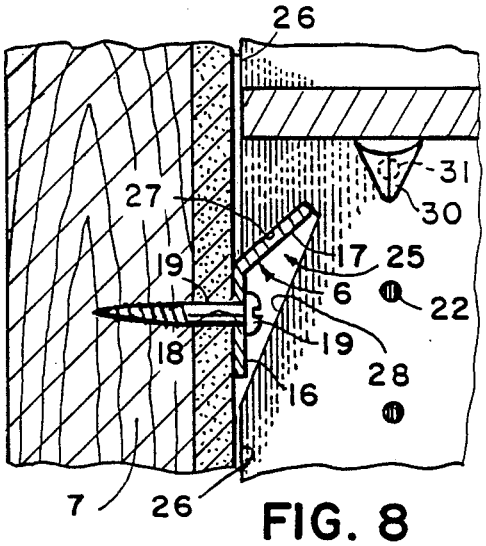
FIG. 8
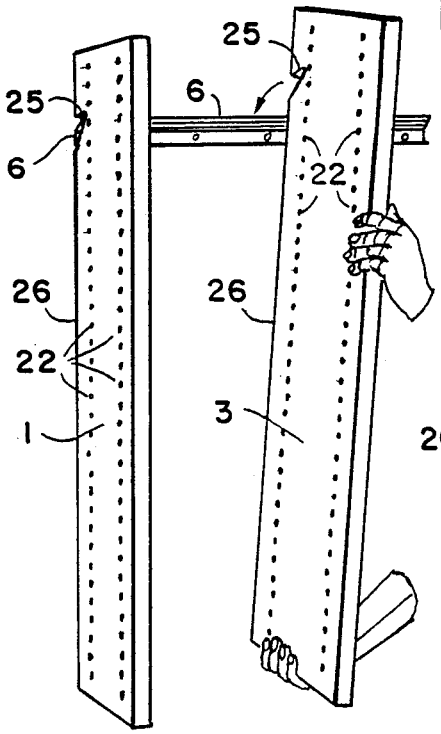
FIG. 5
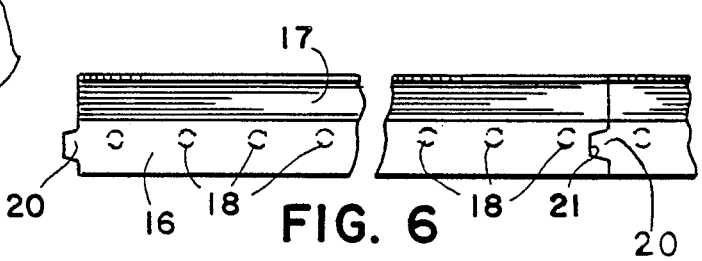
FIG. 6
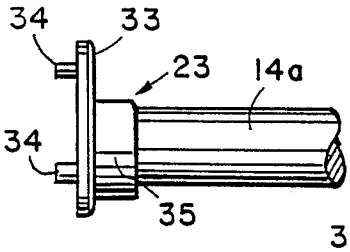
FIG. 9
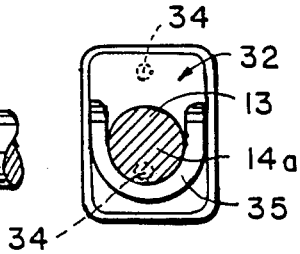
FIG. 10

STORAGE ORGANIZER SYSTEM AND MEANS FOR INSTALLING THE SAME

This invention relates to a storage organizer system and means for installing the same. This system can be used as a closet organizer or for storing in different places such as a garage, basement, pantry or laundry.

BACKGROUND OF THE INVENTION

The present day trend for storing articles such as clothing, household articles and tools is to provide a knockdown system which includes a number of upright or vertical panels between which are mounting shelving, clothes rods and frequently drawers The shelves are adjustable and many different arrangements are provided for such as double hanging rods, shelving at the lower portion of the panels and clothes rods over the shelves and single rods mounted at the top of the panels for hanging long items, such as coats, etc. Although the organizing systems have become very popular, many of them are quite expensive and difficult to install within the storage space such as closets. To my knowledge, no inexpensive, easily installed storage system was conceived prior to this present invention.

SUMMARY OF THE INVENTION

The above need for a low cost storage organizer system which can be easily installed within a relatively short time as compared to other wall mounted or floor mounted storage organizers is met by this invention. The installation of the organizer of this invention can be done by do-it-yourselfers, contractors or closet contractors in a relatively short time.

In accordance with this invention, I provide a storage organizer system and the means for installing the same which serves the same purpose as other present day organizers but includes a unique construction which can be sold as a knockdown unit and easily installed. This system includes a horizontal rail adapted to be mounted on the wall in the storage space. This rail includes a projection extending upwardly and away from the wall and is mounted horizontally on the wall. The system also includes several panels, the number depending upon the desired storage configuration. Each of the panels have any edge abutting the wall with a cutout shaped to be received by the projection of the horizontal rail. Thus the upright panels are hung on the rail so as to project perpendicular from the wall. The panels are spaced to receive therebetween support members such as shelves, drawers, and rods. The upright panels can be slid along the rail to proper spacing in order to accommodate the previously cut shelves or drawers. The rods can be cut or telescoped to the proper length so as to fit snugly between selected ones of the upright panels.

Preferably, at least three upright panels are provided including two end panels and one or more intermediate panels. The end panels are preferably mounted against the side wall of the storage compartment such as a closet and the intermediate panels are mounted between the two side panels. In using at least three panels, two of the panels are spaced to correspond with the length of the shelves and the width of the drawers. The support rods are cut to just the right length to provide a tight fit between the other two panels so as to hold the panels, shelves, and drawings in place.

In accordance with the method of this invention, the rail is first secured to the wall, the vertical or upright panels are hung on the rail with a spacing to fit the shelf lengths and/or drawer widths The shelves and drawers are mounted between two of the vertical panels The closet rods are then cut to the desired length so as to provide a tight fit to prevent the panels or rods from shifting. In some instances where a shelf is provided above closet rods, the shelf has to be cut to also provide a tight fit.

In accordance with this invention, I have provided a low cost storage organizer system that is simple and easy to install and in which the shelves can be adjusted vertically and horizontally. This system can be removed and reinstalled at another location such as a new home. It is very simple system in which the only fasteners are those which secure the horizontal rail to the wall of the storage space. Other features and advantages of the invention will become evident from the detailed description of the preferred embodiment as described hereinbelow.

BRIEF DESCRIPTION OF THE DRAWINGS

FIG. 1 is a elevational, front, perspective view of a storage organizer system illustrating the system of this invention;

FIG. 2 is a front, elevational view of the storage organizer system of FIG. 1;

FIG. 3 is an enlarged, elevational, perspective view of a portion of the system of FIGS. 1 and 2;

FIG. 4 is an elevational, perspective view of a portion of the system taken through a cutaway of one of the side walls between which the system is installed;

FIG. 5 is an elevational, perspective view illustrating the step of hanging one of the upright panels on the support rail of the system;

FIG. 6 is a front, elevational view showing the connection of two sections of the support rail forming a part of this invention;

FIG. 7 is a side, elevational view of the support rail;

FIG. 8 is a cutaway or cross section of a portion of the system including the support rail mounted to a wall, the upright panel hung on the support rail and a shelf mounted on the upright panel;

FIG. 9 is a side, elevational view of the rod support and a portion of a rod;

FIG. 10 is a front, elevational view of the rod support and rod; and

FIG. 11 is a partial, side elevational, cross-sectional view of another embodiment of the cutout in the panels.

BRIEF DESCRIPTION OF THE PREFERRED EMBODIMENT

Referring to the drawings, FIGS. 1 and 2, disclose a specific storage organizer which illustrates the system of this invention. This storage organizer includes a plurality of upright panels including the end panels 1 and 2 between which are located intermediate panels 3, 4 and 5. All of these upright panels are mounted on the support rail 6 attached to the wall as specifically disclosed in FIGS. 1 and 2. The two side panels 1 and 2 are mounted immediately adjacent and abutting the side walls 8 and 9, respectively. The upright panel 3 is mounted on rail 6 a distance from panel 1 to accommodate the shelf or top 10*a* and shelves 10*b*, 10*c*, 10*d* and 10*e*. Top or shelf 11*a* and shelves 11*b*, 11*c*, 11*d* and 11*e* are mounted between the upright panels 4 and 5. Mounted between upright panels 2 and 5 is the shelf or top 12*a*, shelf 12 and the rod 13. The last compartment in this system is located between the upright panels 3 and 4. This compartment includes the two rods 14*a* and 14*b*.

The system provides storage for clothing or other items on the shelving 10*b*, 10*c*, 10*d* and 10*e* above the floor, the hanging of clothes on rods 14*a* and 14*b* above the floor, the storage of clothing on shelving 11*b*, 11*c*, 11*d* and 11*e* also above the floor and the storage of clothing on the shelving 12 and the hanging of clothing on rod 13. It is important that this entire unit is entirely supported by the rail 6 as will be described hereinafter.

Referring to each of the components forming up this system, rail 6, as disclosed more specifically in FIGS. 6, 7, and 8, includes an elongated, metal rail having two legs 16 and 17 arranged at an angle approximately 50° from each other. The leg 16 has a plurality of spaced openings 18 through which screws 19 are inserted for securing the rail to the studs of the wall 7. There are a sufficient number of these openings so that at least one of them can be aligned with each of the studs in the wall. The mounting or support rails 6 are generally 4 or 8 feet in length and in order to use several rails to accommodate greater lengths of organizer systems, one end of the rail has a truncated shaped extension 20 while the other end has a correspondingly shaped cutout or recess 21 for receiving an extension 20 of an adjacent end of the rail as disclosed in FIG. 6. The mounting rail is constructed of 12 gauge steel 1 ½" wide and bent at its longitudinal center to produce the two legs 16 and 17.

The vertical panels are identical. They are preferably 48" long, 12" wide and ⅝" thick laminated panels, although the panels could be made of solid wood or any other material and be of different lengths and widths. Two vertical rows of 32 mm holes 22 are provided on each side of the panels, as disclosed in FIGS. 1, 3, 4 and 5. These holes are provided to receive rod end supports 23 and shelf pins 24 which will be described in greater detail hereinafter.

Of extreme importance to this invention is the cutout 25 in the edge 26 of each panel that abuts against the wall 7. This cutout 25, as disclosed in FIGS. 1–10, is substantially triangular in shape and has the two elongated sides 27 and 28. The angles between these two sides are such as to accommodate and receive the leg 17 of rail 6. Thus, the side 27 of cutout 25 approximates the angle between the legs 16 and 17 of rail 6 which is approximately 50°. The side 28 of cutout 25 is such as to eliminate any interference between the side 28 and the rail 6. Thus, as will be seen in FIG. 8, it extends approximately from the end of leg 17 to just below the end of leg 16 of rail 6. The cutout 25 can take many different configurations without departing from the spirit of this invention. One example of a different configuration is shown in FIG. 11 wherein the cutout 25*a* is formed by a router so as to provide the side 27*a* supported by leg 17 of the rail 6.

It will be seen from this description and particularly from FIGS. 8 and 11 that each of the panels 1, 2, 3, 4 and 5 are hung on the leg 17 of rail 6 in the manner as disclosed in FIG. 5 so that, as disclosed in FIG. 8, the edge 26 of the panels abut against the wall 7.

The shelves 10*a*, 10*b*, 10*c*, 10*d*, 10*e*, 11*a*, 11*b*, 11*c*, 11*d*, 11*e*, 12 and 15 are mounted between their respective panels in a conventional way. These shelves are constructed of laminated wood, solid wood or any other material. They are mounted on the panels and can be adjustable vertically thereon by changing the position of shelf pins 30 which are also conventional elements that are supported in the openings 22 by pin 31 (FIG. 8). As best disclosed in FIG. 3, the shelf pins are mounted in horizontally-aligned holes or openings 22.

The closet rods 13, 14*a* and 14*b* are supported on the upright panels by the rod end supports 32, shown in greater detail in FIGS. 9 and 10. Rod end supports 32 include the base 33 having the pins 34 extending from one side thereof and a rod support flange 35 extending from the opposite side thereof. Flange 35 is U-shaped to receive a rod such as rod 13. Rod end support 32 is mounted on the panels by the two pins 34 extending into spaced openings or holes 22 and the rod 13 is supported in the saddle portion of the U-shaped flange 35.

Having described all the components of my invention, the method of installation of my organizer system will now be described.

METHOD OF INSTALLATION

The installation of my organizer system is extremely simple as compared to other systems of this type. It starts by establishing the height at which the entire system is to be hung above the floor. Once this distance has been established (which is suggested to be 80"), by the use of a level, a line is drawn on the closet wall 80" above the floor, and the rail 6 is then mounted to the studs of the wall 7 above the line making sure that the screws are secured in the studs. In most instances, two or more sections of the rail are utilized and they are connected together as disclosed in FIG. 6, the projection 20 of one end or one rail extending into the recess 21 of an adjacent rail. However, if 8 foot rails are used generally only one is required The vertical panels 1, 2, 3, 4, and 5 are then hung on the mounting rail 6. Preferably the end panels 1 and 2 are mounted adjacent the sidewalls 8 and 9. Panel 3 is hung on the rail at a predetermined distance established by the length of the shelves 10*a*, 10*b*, 10*c*, 10*d* and 10*e* . These shelves can then be mounted between panels 1 and 3 by means of the shelf pins 24 inserted into the desired openings to give the desired spacing between the shelves which can be varied by time to time. Next, panel 5 is spaced a distance from panel 2 as determined by the length of shelves 12 and 12*a* and these shelves can be mounted between the panels 2 and 5 by means of shelf pins 24. The rod 13 is also supported between the panels 2 and 5 by means of the rod end supports 32. Care should be taken that the rod 13 is of proper length to correspond with the lengths of the shelves 12 and 12*a* so that the panels 2 and 5 are parallel to each other.

Panel 4 is next adjusted along the rail 6 so as to be spaced from panel 5 a distance determined by the length of the shelves 11*a*, 11*b*, 11*c*, 11*d* and 11*e*. The shelf pins 24 are then inserted in appropriate openings 22 and shelves 11*a*, 11*b*, 11*c*, 11*d* and 11*e* are supported thereon.

The last and final installation steps in the configuration as disclosed is to insert the rod end support pins 34 into openings near the top and bottom of the panels 3 and 4. The rods 14*a* and 14*b* are then carefully cut to the proper length so that there will be a snug fit within the rod end supports between the panels 3 and 4. This snug or tight fit exerts a force on the panels 3 and 4 so as to prevent shifting of the panels. It should be understood that with such a tight fit, the force exerted on panel 4 is transmitted to panel 5 and in turn is transmitted to panel 2 and the sidewall 9. Correspondingly, the force exerted on panel 3 is exerted on panel 1 and the sidewall 8. This provides a very sturdy and secure organizer system because of the tight fit left to right which holds the horizontal members in place.

It should be clear from the above description that my storage organizer system, particularly useful in closets, has a low initial cost because of the lack of any requirement for any expensive brackets or other support elements. It is less expensive because of the low installation time as compared to the wall mounted or floor mounted organizer panels. It is so simple to install that it can be done by do-it-yourselfers as well as contractors or closet contractors. All the parts can be assembled very easily in a relatively small package. Further, it provides fully adjustable vertical and horizontal storage depending upon the components selected. It can be removed very easily by disassembling and reinstalling in another location.

It should be understood that although I have described my invention in conjunction with a clothes closet, my system can be used for storage organization in garages, basements, pantries, linen closets and laundries.

Although I have described a preferred embodiment of my invention, it should be understood that several different embodiments and modifications can be made without departing from the real spirit of this invention. Therefore, this invention should be limited only as set forth in the following appended claims.

The embodiments of the invention in which an exclusive property or privilege is claimed are defined as follows.

1. In a storage organizer system mounted adjacent a wall of a storage space comprising a plurality of upright panels extending perpendicular to said wall and supporting support members therebetween, the improvement comprising a horizontal rail mounted on said wall and having a projection extending upwardly and away from said wall; and each of said panels having an edge abutting said wall with a cutout portion receiving said projection whereby said panels and the support members therebetween are hung on said rail; said cutout portions being shaped so as to receive said projection as said panel is moved perpendicular to said wall and said cutout portion is dropped down and over said projection.

2. In a storage organizer system mounted adjacent a wall of a storage space comprising at least two upright end panels extending perpendicular to said wall and supporting support members therebetween, a horizontal rail mounted on said wall and having a projection extending upwardly and away from said wall; and each of said panels having an edge abutting said wall with a cutout portion receiving said projection whereby said panels and the support members therebetween are hung over said rail; means adjacent each end panel for preventing the end panels from spreading away from each other; and said support members being of a length to fit snugly between said end panels to provide a tight fit to hold said panels and support members in place.

3. The storage organizer system of claim 1 in which the number of upright panels mounted on said rail are at least three including two end panels and at least one intermediate panel located between said end panels; means adjacent each end panel for preventing the end panels from spreading away from each other; and said support members being of a length to fit snugly between adjacent ones of said panels to provide a tight fit to hold the said panels and support members in place.

4. The storage organizer of claim 1 in which at least some of the support members comprise shelving.

5. The storage organizer of claim 1 in which at least some of the support members comprise clothes rods.

6. The storage organizer of claim 2 in which at least some of the support members comprise shelving.

7. The storage organizer of claim 1 in which at least some of the support members comprise clothes rods.

8. The storage organizer of claim 1 in which the means adjacent the end panels are walls of the storage enclosure.

9. The storage organizer of claim 1 in which the rail includes two legs extending at an angle from each other, one of said legs being secured to said wall and the other being said projection extending upwardly and away from said wall.

10. The storage organizer of claim 2 in which the rail includes two legs extending at an angle from each other, one of said legs being secured to said wall and the other being said projection extending upwardly and away from said wall.

11. The storage container of claim 1 in which the projection includes an upper surface extending at an acute angle from said wall and said cutout portion of each panel includes a surface extending from the edge of said each panel whereby when hooked on said projection the said surface of each panel slides by gravity on said projection causing said panel edge to abut said wall and the panel to be held by gravity on and against said wall.

12. A method for installing a storage organizer system adjacent the wall of a storage space comprising the steps of: providing a rail having mounting means for securing it to a wall and a projection extending at an angle from said mounting means; securing said rail to said wall with said projection extending upwardly and away from said wall; providing a plurality of upright panels each having at least one cutout portion along one upright edge, said cutout portion being shaped so as to receive said projection as said panel is moved substantially perpendicular to said wall with said cutout portion above said projection and said cutout portion is dropped down and hooked over said projection; moving each of said panels toward said wall with the panel perpendicular to said wall and with said cutout portion above said projection of said rail; and dropping each of said cutout portions downwardly to hook said cutout portions over said projection so as to arrange said panels in parallel spaced relationship to each other with the said upright edges abutting said wall, said panels being spaced a predetermined distance or distances; providing a plurality of support members of a length equal to said predetermined distance or distances; and mounting said support members between said panels.

13. A method for installing a storage organizer system adjacent the wall of a storage space comprising the steps of: providing a rail having mounting means for securing it to a wall and a projection extending at an angle from said mounting means; securing said rail to said wall with said projection extending upwardly and away from said wall; providing at least two end upright panels having cutouts along one upright edge, said cutouts being shaped to receive said projection for hanging said panels on said rail; hanging said panels on said rail in parallel spaced relationship to each other with the said upright edges abutting said wall, said panels being spaced a predetermined distance or distances; providing a plurality of support members of a length equal to said predetermined distance or distances; and mounting said support members between said panels; said end panels being hung on said rail in conjunction with means for preventing the end panels from spreading away from each other; said support members being cut of a length to fit snugly between said panels whereby when mounted therebetween a tight fit is provided to hold the support members in place.

14. The method of claim 12 in which the number of upright panels hung on said rail are at least three including two end panels and at least one intermediate panel located between said end panels; said end panels being hung on said rail in conjunction with means for preventing the end panels from spreading away from each other; said support members being cut of a length to fit snugly between adjacent ones of said panels whereby when mounted therebetween a tight fit is provided to hold the support members in p lace.

15. The method of claim 13 in which the panels are mounted between spaced walls extending perpendicular to said wall and in the said step of hanging the panels the end panels are hung with one side of each end panel abutting against one of said spaced walls to thereby prevent spreading of said end panels when the support members are mounted in a tight fit between the panels.

* * * * *